US009526398B2

(12) United States Patent
Larose

(10) Patent No.: US 9,526,398 B2
(45) Date of Patent: Dec. 27, 2016

(54) RACK FOR RECEIVING DISHES, TO BE INSERTED INTO A DISHWASHER

(71) Applicant: Nicolas Larose, Nogent-sur-Marne (FR)

(72) Inventor: Nicolas Larose, Nogent-sur-Marne (FR)

( * ) Notice: Subject to any disclaimer, the term of this patent is extended or adjusted under 35 U.S.C. 154(b) by 0 days.

(21) Appl. No.: 14/408,169

(22) PCT Filed: Jun. 13, 2013

(86) PCT No.: PCT/FR2013/000153

§ 371 (c)(1),
(2) Date: Dec. 15, 2014

(87) PCT Pub. No.: WO2013/186450

PCT Pub. Date: Dec. 19, 2013

(65) Prior Publication Data

US 2015/0136181 A1 May 21, 2015

(30) Foreign Application Priority Data

Jun. 15, 2012 (FR) ..... 12 01724

(51) Int. Cl.
*A47G 29/08* (2006.01)
*A47L 15/50* (2006.01)

(52) U.S. Cl.
CPC ..... *A47L 15/501* (2013.01)

(58) Field of Classification Search
CPC ..... A47L 15/50; A47L 15/501; A47L 15/505; A47L 15/507; A47L 19/00; A47L 19/04; A47L 15/502; A47L 17/02; A47B 73/00; A47J 47/16
USPC ..... 211/41.8, 41.9, 74, 126.2, 13.1, 183; D32/3; 134/135; 220/485–488
See application file for complete search history.

(56) References Cited

U.S. PATENT DOCUMENTS 1,088,642 A * 2/1914 Wilcox ..... A47B 73/00 206/427
2,741,392 A * 4/1956 Weiss ..... A47L 15/0065 211/74
2,832,499 A * 4/1958 Maslow ..... A47L 15/501 211/41.8
3,217,890 A * 11/1965 Maslow ..... A47L 15/501 211/41.8
3,333,722 A * 8/1967 Panknin ..... B65D 7/14 206/503
3,348,723 A * 10/1967 Wilson ..... B65D 19/12 108/53.5
4,118,081 A * 10/1978 Barrientos ..... A47J 47/16 206/499

(Continued)

FOREIGN PATENT DOCUMENTS

CN 101966069 2/2011
CN 101977539 2/2011

(Continued)

*Primary Examiner* — Jennifer E Novosad
(74) *Attorney, Agent, or Firm* — Occhiuti & Rohlicek LLP

(57) ABSTRACT

A rack for receiving dishes, intended to be inserted into a dishwasher, including a frame delimiting an upper area and a lower area between which a support grid for supporting the dishes is arranged. The upper area including receptacles for receiving the dishes and the lower area is equipped with at least one flap. The flap is moveable between a closed position in which the flap blocks a lower window bordered by the frame and an open position in which the flap allows passage through the lower window.

8 Claims, 2 Drawing Sheets

(56) References Cited

U.S. PATENT DOCUMENTS

| | | | | | |
|---|---|---|---|---|---|
| 4,527,707 | A * | 7/1985 | Heymann | A47L 19/02 | 211/126.1 |
| 4,621,739 | A * | 11/1986 | Heymann | A47L 19/04 | 211/126.14 |
| 4,732,291 | A * | 3/1988 | McConnell | A47L 15/505 | 220/488 |
| 4,830,200 | A * | 5/1989 | Zambano | A47L 15/505 | 211/133.5 |
| 5,294,008 | A * | 3/1994 | Dunaway | A47L 15/505 | 211/41.9 |
| 5,497,890 | A * | 3/1996 | Clark | A47L 15/505 | 211/198 |
| 5,605,236 | A * | 2/1997 | Welch | A47L 15/50 | 211/41.8 |
| 5,740,724 | A * | 4/1998 | Fabrikant | A47J 37/0694 | 220/486 |
| 8,087,519 | B2 * | 1/2012 | Bramley | A47L 15/505 | 211/41.3 |
| 8,312,887 | B2 * | 11/2012 | Dunn | A47L 15/505 | 134/135 |
| 2008/0272126 | A1 * | 11/2008 | Crookshanks | A47L 15/502 | 220/486 |
| 2009/0050587 | A1 * | 2/2009 | Sandor | A47L 15/501 | 211/74 |
| 2013/0233353 | A1 * | 9/2013 | Vacca | A47L 15/501 | 134/25.2 |

FOREIGN PATENT DOCUMENTS

| | | |
|---|---|---|
| EP | 0272795 | 6/1988 |
| JP | 2001029202 | 2/2001 |

* cited by examiner

RACK FOR RECEIVING DISHES, TO BE INSERTED INTO A DISHWASHER

RELATED APPLICATIONS

This application is a U.S. National Stage of international application number PCT/FR2013/000153 filed Jun. 13, 2013, which claims the benefit of the priority date of French Patent Application FR 1201724, filed Jun. 15, 2012, the contents of which are herein incorporated by reference.

FIELD OF THE INVENTION

The invention relates to the field of machines for washing or rinsing dishes or tableware. It consists in a rack intended to receive the dishes or tableware before it is introduced into the interior of the machine. It also consists in a method of using such a rack.

BACKGROUND

In the catering field, a rack is known that is intended to receive dishes, such as glassware, plates, cooking utensils, tableware or containers used to prepare food. Such a rack consists of a frame that houses cells, fingers or supports for receiving the dishes. A user places the dirty dishes inside the rack top to tail or in a vertical position to facilitate cleaning thereof inside the machine. Such placement has the disadvantage of causing dirt to flow from the dishes to the interior of the rack. The rack being apertured to enable flow of a washing liquid through the rack when inside the machine, this results in soiling of a support on which the rack is placed during the operation of filling it with dishes.

More particularly, there are already known in the prior art systems of racks for glasses or cups, saucers, etc. that consist of a parallelepiped open on one of its faces and including a plane grid at the bottom allowing water or a washing and/or rinsing liquid to circulate. Such racks are devices rented for receptions together with the glasses or cups, bowls, saucers and other liquid containers. The containers are sent out upside down in the rack, i.e. the mouth of each container is disposed on the bottom grid, so that the stem or bottom of the container faces upward. This arrangement is in fact necessary for two reasons: the first is that, for esthetic reasons, the service personnel must necessarily grasp the stem or bottom of the container so as not to mark the top of the container and, for hygienic reasons, so as not to introduce their fingers into the interior of the container. The second reason is that the containers have been washed in an industrial dishwasher inside the system of racks for containers. The washing and/or rinsing liquid must in fact penetrate to the interior of the containers for better washing/rinsing.

When the liquid containers have been used, the service personnel replaces them as and when they are used inside the rack for containers, at the place, namely, the stem or bottom of the container being placed on the bottom of the rack for containers. In the prior art, it is necessary to turn the liquid containers over one by one so that their bottom again faces toward the top of the rack for containers and therefore enables them to drain, as well as enabling better washing/rinsing in the industrial dishwasher. Such manipulation of the containers has disadvantages. A first disadvantage is that turning them over manually can lead to significant breakage of containers. Now, these are usually made of high-quality and costly materials such as crystal or porcelain. A second disadvantage of this manipulation of the containers is that it requires considerable and therefore costly labor.

There has therefore been in the prior art a search for eliminating this turning the containers over manually after each use.

The document JP2001029202 describes in a general way such a rack that is associated with a box into which the rack is introduced during the filling operation. The box includes a bottom wall on which the rack rests. The bottom wall is able to collect any dirt.

Such a device nevertheless has numerous disadvantages. Firstly, it necessitates a box that must be cleaned regularly, which lengthens the overall process of washing the dishes. Secondly, it is necessary to introduce the rack into the interior of the box at the start of the operation of filling the rack with dishes, after which it is necessary to extract the filled rack from the box to introduce it into the machine, resulting in tedious manipulations that further lengthen the overall process of washing the dishes and moreover cause breakage of dishes, which it is preferable to avoid.

SUMMARY

One aim of the present invention is to propose a rack intended to receive dishes before introduction thereof into a dishwasher, the rack being adapted to avoid soiling of a support on which the rack is positioned, such a rack being easy to manipulate and facilitating manipulation of the dishes. Another aim of the present invention is to propose a rack able to receive liquid containers, such as cups or glasses, such a rack enabling said containers to be placed on entering the dishwasher as said containers will be used on leaving it, i.e. top to tail, which avoids manipulation and breakages. A further aim of the present invention is to propose a method of using such a rack that is simple to use and enables protection of a support on which such a rack is placed during a step of filing said rack with dirty dishes.

A rack in accordance with the present invention is a rack for receiving dishes, intended to be inserted into a dishwasher. The rack includes a frame delimiting a upper area and a lower area between which a grid for supporting dishes is arranged. The upper area includes receptacles for receiving dishes.

According to the present invention, the lower area is equipped with at least one flap that is moveable between a closed position in which the flap blocks a lower window bordered by the frame and an open position in which the flap allows passage through the lower window.

The flap is advantageously rotatable about a rotation axis that is orthogonal to two opposite posts of the frame.

There is preferably a plurality of flaps and are disposed in the closed position parallel to one another in a flap plane.

The flap plane is preferably parallel to a grid plane in which the support grid is disposed.

The flaps are notably equipped with maneuvering means for conjointly closing and/or opening them.

In accordance with a first embodiment the frame is in one piece.

In accordance with a second embodiment the frame consists of an upper individual frame including the support grid and a lower individual frame including the flap.

The upper individual frame and the lower individual frame are preferably equipped with means for reversibly assembling them to each other.

A method in accordance with the present invention is a method of using such a rack that is mainly recognizable in that the method includes a step of filling the rack with dishes with the flap placed in the closed position and a step of washing the dishes with the flap placed in the open position.

BRIEF DESCRIPTION OF THE DRAWINGS

Other features and advantages of the present invention will become apparent on reading the description to be given of embodiments thereof with reference to the figures of the appended drawings, in which.

DETAILED DESCRIPTION

Figure 1:
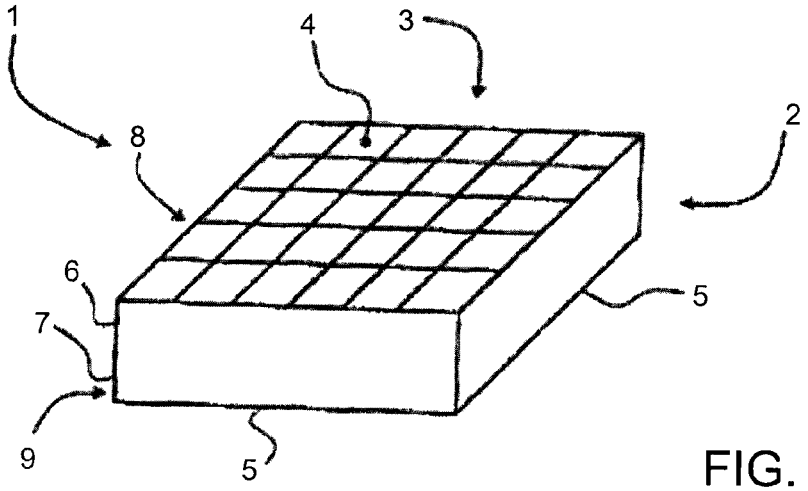
FIG. 1 is a schematic perspective view of a first embodiment of a rack in accordance with the present invention.

In FIG. 1, a rack 1 in accordance with the present invention is intended to receive dishes before it is introduced inside a dishwasher. The rack 1 includes a frame 2 that delimits cells 3 to receive the dishes, such as glasses, plates, cooking utensils, tableware or containers used to prepare food. The frame 2 is of parallelepiped general shape and the frame 2 delimits an internal volume 3 inside which the dishes are placed. The internal volume 3 accommodates for example receptacles 4 such as cells to receive glasses and/or spikes and/or fingers to receive plates or the like. The frame 2 includes four posts 5 that are disposed in facing pairs to delimit the generally parallelepiped internal volume 3.

In a first embodiment represented in FIG. 1, the frame 2 is in one piece.

Figure 2:
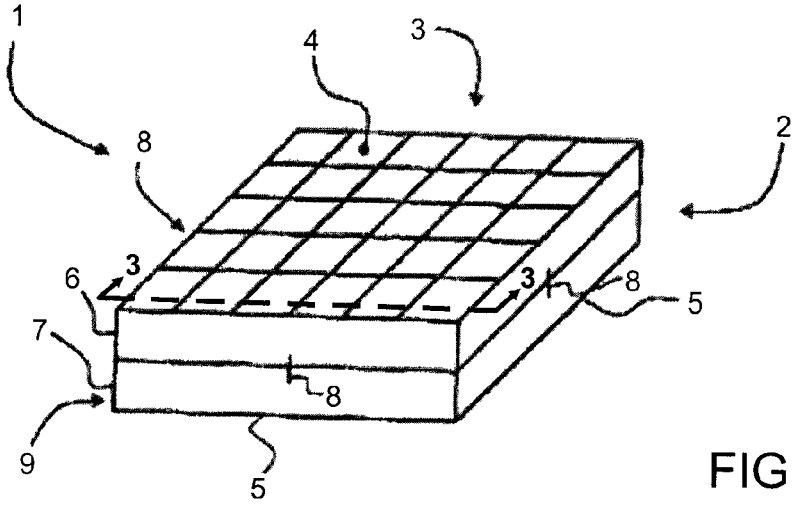
FIG. 2 a schematic perspective view of a second embodiment of a rack in accordance with the present invention.

In a second embodiment represented in FIG. 2, the frame 2 consists of an upper individual frame 6 and a lower individual frame 7 that are stacked one on the other, the upper individual frame 6 overlying the lower individual frame 7. The upper individual frame 6 and the lower individual frame 7 are reversibly assembled to each other by assembly means 8 of the interlocking or similar type.

Figure 3:
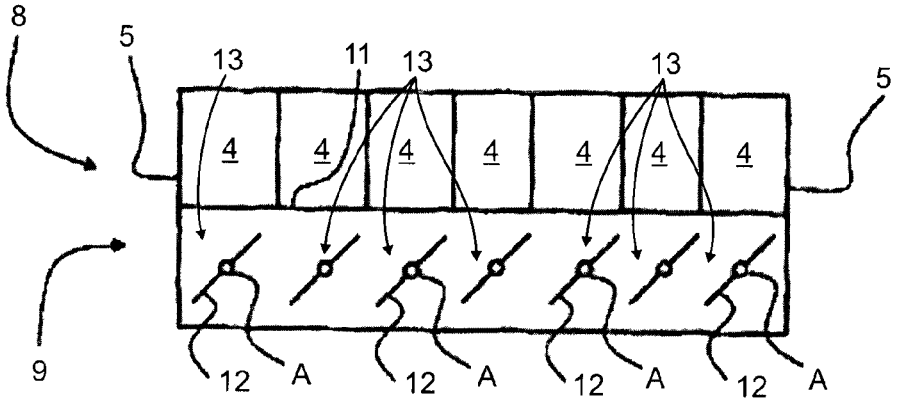
FIGS. 3 to 5 are sectional views of the rack shown in the previous figures.

Referring also to FIG. 3, and in accordance with the two embodiments referred to above, the frame 2 delimits an upper area 9 and a lower area 10 that are separated from each other by a grid 11 to support the dishes. The latter is apertured to allow a washing liquid to pass through it when it is inside the dishwasher.

Figure 4:
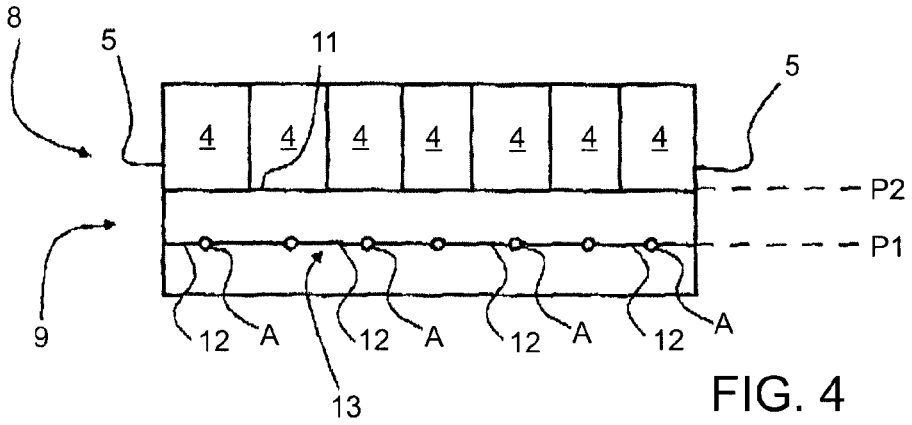

In accordance with the present invention, the lower area 10 is equipped with a plurality of flaps 12 that are rotatable about a rotation axis A that extends between two facing posts 5. The flaps 12 are mobile between a closed position in which the flaps block a lower window 13 bordered by the lower individual frame 7 and an open position in which the flaps allow passage through the lower window 13. In the closed position shown in FIG. 4 the flaps 12 are parallel to one another and disposed in a flap plane P1. The flap plane P1 is preferably parallel to the grid plane P2 in which the dish support grid 11 is disposed.

Figure 5:
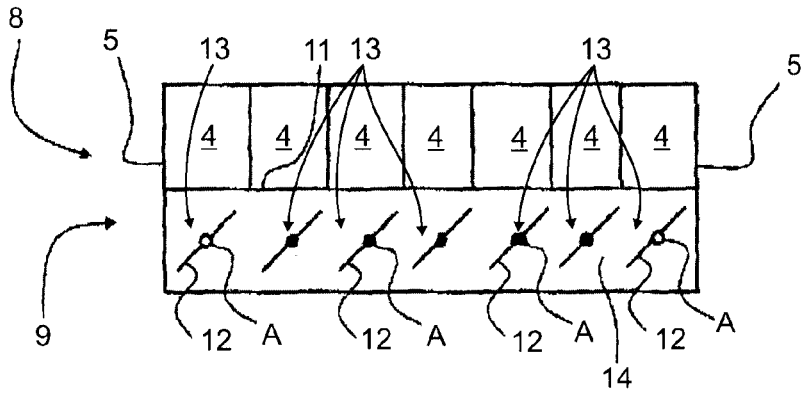

In FIG. 5, which represents the flaps 12 in the open position, the latter are provided with maneuvering means 14 for conjointly placing them in the closed or open position. Such means 14 consist for example of a rod connecting the flaps 12 together to maneuver them simultaneously.

These arrangements are such that a method of using such a rack 1 advantageously includes a step of filling the rack 1 with dishes, the flap 12 being placed in the closed position, and a step of washing the dishes, the flap 12 being placed in the open position. These arrangements are such that a support on which the rack 1 is placed is free of dirt when filling the rack with dishes and the rack 1 can easily be cleaned with the dishes that the latter carries when the flap 12 is placed in the open position.

The invention claimed is:

1. A rack for receiving dishes intended to be inserted into a dishwasher, the rack including:

a frame;

an upper area and a lower area both delimited by said frame;

a support grid disposed between the upper area and the lower area, the support grid configured to support the dishes;

wherein the upper area includes receptacles for receiving the dishes;

wherein the lower area includes a plurality of flaps disposed across the lower area, which are moveable between an open position defining a plurality of windows bordered by the frame and a closed position in which the plurality of flaps block the plurality of windows; and wherein the plurality of flaps are disposed, when in the closed position, parallel to one another in a single flap plane (P1).

2. The rack as claimed in claim 1, wherein each of the plurality of flaps are rotatable about a rotation axis (A) that is orthogonal to two opposite posts of the frame.

3. The rack as claimed in claim 1, wherein the flap plane (P1) is parallel to a grid plane (P2) in which the support grid is disposed.

4. The rack as claimed in claim 1, wherein the plurality of flaps are equipped with maneuvering means for conjointly closing and opening them.

5. The rack as claimed in claim 1, wherein the frame is in one piece.

6. The rack as claimed in claim 1, wherein the frame comprises an upper individual frame including the support grid and a lower individual frame including the plurality of flaps.

7. The rack as claimed in claim 6, wherein the upper individual frame and the lower individual frame are equipped with means for interconnecting them to each other.

8. A method of using a rack as claimed in claim 1, wherein the method includes a step of filling the rack with dishes with the plurality of flaps placed in the closed position and a step of washing the dishes with the plurality of flaps placed in the open position.

* * * * *